US010252880B2

(12) United States Patent
Simcik et al.

(10) Patent No.: US 10,252,880 B2
(45) Date of Patent: Apr. 9, 2019

(54) SYSTEM AND METHOD OF INITIATING ELEVATOR SERVICE BY ENTERING AN ELEVATOR CALL

(71) Applicant: Otis Elevator Company, Farmington, CT (US)

(72) Inventors: Paul A. Simcik, Southington, CT (US); Eric C. Peterson, East Longmeadow, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/344,403

(22) Filed: Nov. 4, 2016

(65) Prior Publication Data

US 2017/0129739 A1 May 11, 2017

Related U.S. Application Data

(60) Provisional application No. 62/251,754, filed on Nov. 6, 2015.

(51) Int. Cl.
*B66B 1/16* (2006.01)
*B66B 1/46* (2006.01)

(52) U.S. Cl.
CPC ..... *B66B 1/468* (2013.01); *B66B 2201/463* (2013.01); *B66B 2201/4615* (2013.01);
(Continued)

(58) Field of Classification Search
CPC ..... B66B 1/468; B66B 2201/103; B66B 2201/4615
See application file for complete search history.

(56) References Cited

U.S. PATENT DOCUMENTS 8,136,636 B2 3/2012 Bahjat et al.
8,397,874 B2 3/2013 De Groot
(Continued)

FOREIGN PATENT DOCUMENTS

JP 2009062151 A 3/2009
WO 2014116182 A1 7/2014
WO 2015094178 A1 6/2015

OTHER PUBLICATIONS

International Search Report and Written Opinion for application PCT/US2016/060711, dated Nov. 6, 2015 10 pages.
(Continued)

*Primary Examiner* — Marlon Fletcher
(74) *Attorney, Agent, or Firm* — Cantor Colburn LLP

(57) ABSTRACT

In one aspect, a method for initiating elevator service by entering an elevator call on a call input device having a plurality of graphical objects displayed on a graphical user interface is provided. The method includes the steps of selecting a first landing graphical object from the plurality of graphical objects, and selecting a second landing graphical object from the plurality of graphical objects. The method also includes selecting a third landing graphical object from the plurality of graphical objects. The method also includes creating an anticipated trip graphical object, the anticipated trip graphical object indicating a trip from the third landing to the first landing. The method also includes selecting the anticipated trip graphical object to initiate a hall call and floor call from the third landing to the first landing.

10 Claims, 4 Drawing Sheets

(52) U.S. Cl.
CPC ..... *B66B 2201/4638* (2013.01); *B66B 2201/4653* (2013.01)

(56) References Cited

U.S. PATENT DOCUMENTS

| | | | | |
|---|---|---|---|---|
| 8,566,032 | B2 | 10/2013 | Chowdhary et al. | |
| 8,655,799 | B1 | 2/2014 | Rubin | |
| 9,046,373 | B2 | 6/2015 | Bandyopadhyay et al. | |
| 9,078,090 | B1 | 7/2015 | Shahmoon et al. | |
| 2012/0048655 | A1 | 3/2012 | Hsu | |
| 2012/0255812 | A1* | 10/2012 | Talonen | B66B 1/2458 187/382 |
| 2014/0131142 | A1* | 5/2014 | Parkkinen | B66B 3/006 187/382 |
| 2014/0365119 | A1 | 12/2014 | Haverinen et al. | |
| 2014/0378159 | A1 | 12/2014 | Dolbakian et al. | |
| 2015/0075914 | A1 | 3/2015 | Armistead et al. | |
| 2015/0149133 | A1 | 5/2015 | Do | |
| 2015/0192414 | A1 | 7/2015 | Das et al. | |
| 2016/0122157 | A1* | 5/2016 | Keser | B66B 1/468 187/388 |
| 2017/0129739 | A1* | 5/2017 | Simcik | B66B 1/468 |
| 2017/0305716 | A1* | 10/2017 | Peterson | B66B 1/468 |
| 2017/0341903 | A1* | 11/2017 | Adkins | B66B 1/463 |
| 2017/0355556 | A1* | 12/2017 | Simcik | B66B 1/468 |

OTHER PUBLICATIONS

Kaplan, Melanie D. G., "Intelligent elevators answer vertical challenges" ZDNet, Jul. 17, 2012, 10 pages.
Kone, "Kone RemoteCall—Smartphone Application for Kone Polaris 900 Destination Control", XP055230048, Sep. 13, 2013, 2 pages.

* cited by examiner

SYSTEM AND METHOD OF INITIATING ELEVATOR SERVICE BY ENTERING AN ELEVATOR CALL

CROSS-REFERENCE TO RELATED APPLICATIONS

The present application is a nonprovisional patent application, which claims priority to U.S. Patent Application Ser. No. 62/251,754, filed on Nov. 6, 2015, which is herein incorporated in its entirety.

TECHNICAL FIELD OF THE EXEMPLARY EMBODIMENTS

The present disclosure is generally related to elevator systems and, more specifically, a system and method for initiating elevator service by entering an elevator call.

BACKGROUND OF THE EXEMPLARY EMBODIMENTS

Entering an elevator call from a location away from the elevator provides convenience to a user to allow an elevator car to be potentially ready once the user arrives at the elevator doors. Generally, initiating an elevator call remotely requires an inconvenient and cumbersome process of a user using a mobile device to scroll and/or input an appropriate source and destination landing; then, possibly confirming that the selections made are correct. There is therefore a need for a more intuitive, convenient, and faster method of initiating an elevator call.

SUMMARY OF THE EXEMPLARY EMBODIMENTS

In one aspect, a method for initiating elevator service by entering an elevator call on a call input device having a plurality of graphical objects displayed on a graphical user interface is provided. The method includes the steps of selecting a first landing graphical object from the plurality of graphical objects, and selecting a second landing graphical object from the plurality of graphical objects. The method also includes initiating a hall call and floor call from the first landing to the second landing. The method also includes selecting a third landing graphical object from the plurality of graphical objects. The method also includes initiating a hall call and floor call from the second landing to the third landing. The method also includes creating an anticipated trip graphical object, the anticipated trip graphical object indicating a trip from the third landing to the first landing. The method also includes selecting the anticipated trip graphical object to initiate a hall call and floor call from the third landing to the first landing.

In a further aspect of the above, the method also includes selecting the anticipated trip graphical object.

In a further aspect of any of the above, the call input device comprises a mobile device.

In a further aspect of any of the above, the graphical user interface comprises a touch screen display.

In a further aspect of any of the above, each of the plurality of graphical objects are moveable.

In a further aspect of any of the above, selecting the anticipated trip graphical object also includes touching the anticipated trip graphical object at least once with an object; or initiating a voice command with the call input device.

In one aspect, a system for making elevator calls includes an elevator system and a call input device in communication with the elevator system. The call input device includes a graphical user interface and software configured to display a plurality of graphical objects on the graphical user interface, and initiate an elevator call. Initiating an elevator call includes selecting a first landing graphical object from the plurality of graphical objects. Initiating an elevator call also includes selecting a second landing graphical object from the plurality of graphical objects. Initiating an elevator call also includes initiating a hall call and floor call from the first landing to the second landing. Initiating an elevator call also includes selecting a third landing graphical object from the plurality of graphical objects. Initiating an elevator call also includes initiating a hall call and floor call from the second landing to the third landing. Initiating an elevator call also includes creating an anticipated trip graphical object, the anticipated trip graphical object indicating a trip from the third landing to the first landing. Initiating an elevator call also includes selecting the anticipated trip graphical object to initiate a hall call and floor call from the third landing to the first landing.

In a further aspect of the above, the call input device comprises a mobile device.

In a further aspect of any of the above, the graphical user interface comprises a touch screen display.

In a further aspect of any of the above, each of the plurality of graphical objects are moveable.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE EXEMPLARY EMBODIMENTS

Figure 1:
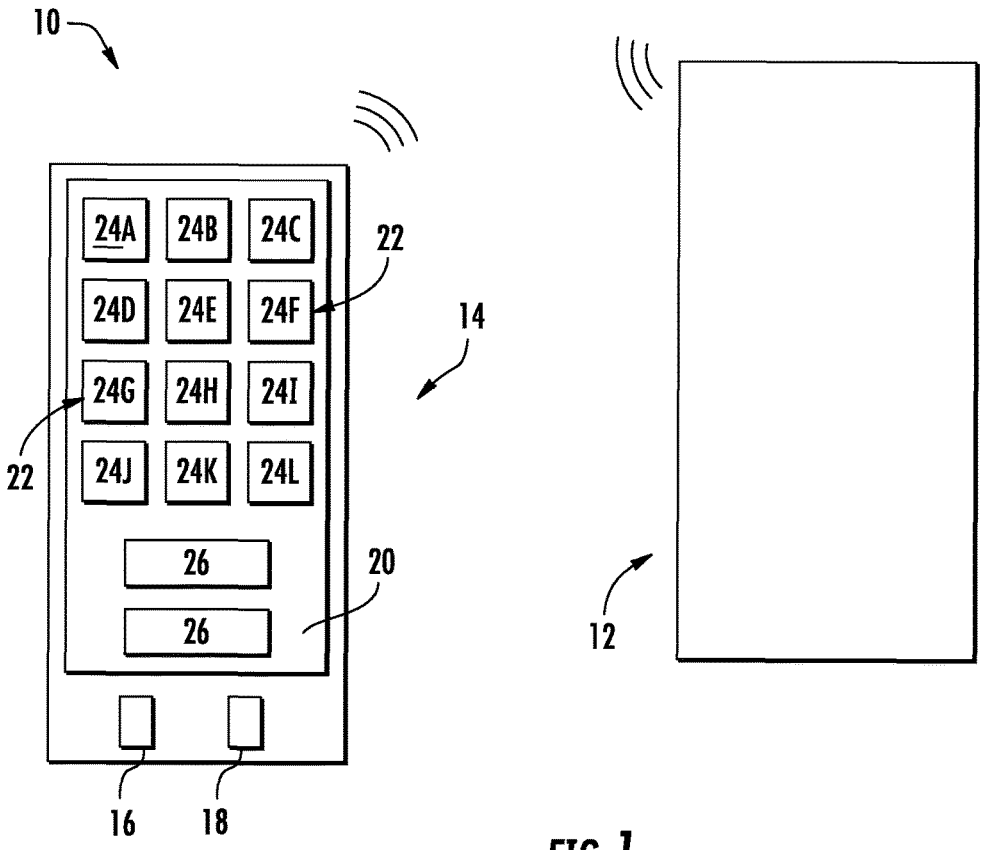
FIG. 1 is a schematic diagram of a system for initiating elevator service.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 schematically illustrates a system for initiating elevator service, generally indicated at 10. The system 10 includes an elevator system 12 and a call input device 14 in communication with the elevator system 12. In one embodiment, the call input device 14 includes a mobile device. It will be appreciated that the call input device 14 may be any mobile device specifically suited for this purpose, for example, a mobile telephone, tablet device, or any device capable of being carried by a person outside of a home to name a few non-limiting examples. It will be appreciated that a communication module (not shown) is located within each of the elevator system 12 and the call input device 14 to enable wireless communication between the elevator system 12 and the call input device 14. The call input device 14 includes a processor 16, memory 18, and a graphical user interface 20. In one embodiment, the graphical user interface 20 includes a touch screen display. A program stored in memory 18 operates to display a plurality of graphical objects 22 on the graphical user interface 20. It will be appreciated that the plurality of graphical objects 22 need not fit on one page of the screen, and may occupy multiple pages on the display. It will also be appreciated that the plurality of graphical objects 22 may be on a current page and accessible via a scrolling action on the display. The program is further configured to initiate a call to the elevator system 12, as described in the method of FIG. 2, by allowing a user to select at least one of the plurality of graphical objects 22. In one embodiment, at least one of the plurality of graphical objects 22 includes a floor graphical object 24. In one embodiment, the floor graphical object 24 is moveable. In one embodiment, at least one of the plurality of graphical objects 22 includes at least one trip graphical object 26.

The system 10 additionally includes a hall fixture containing up-down call buttons (not shown) as are normally used for the input of traditional landing calls, and car call buttons inside the elevator car. Those passengers who have a call input device 14 use it to summon the elevator car to where the user is located and place a call to another landing. Other passengers give a landing call in the traditional manner by pressing the up-down call buttons and a car call via a car operating panel located inside the elevator car.

When a user carrying a call input device 14 initiates elevator service, the call input device 14 and the elevator system 12 establish a connection permitting data transfer. When the user initiates the call, by the method presented in FIG. 2, a communication cycle is started between the call input device 14 and the elevator system 12.

Figure 2:
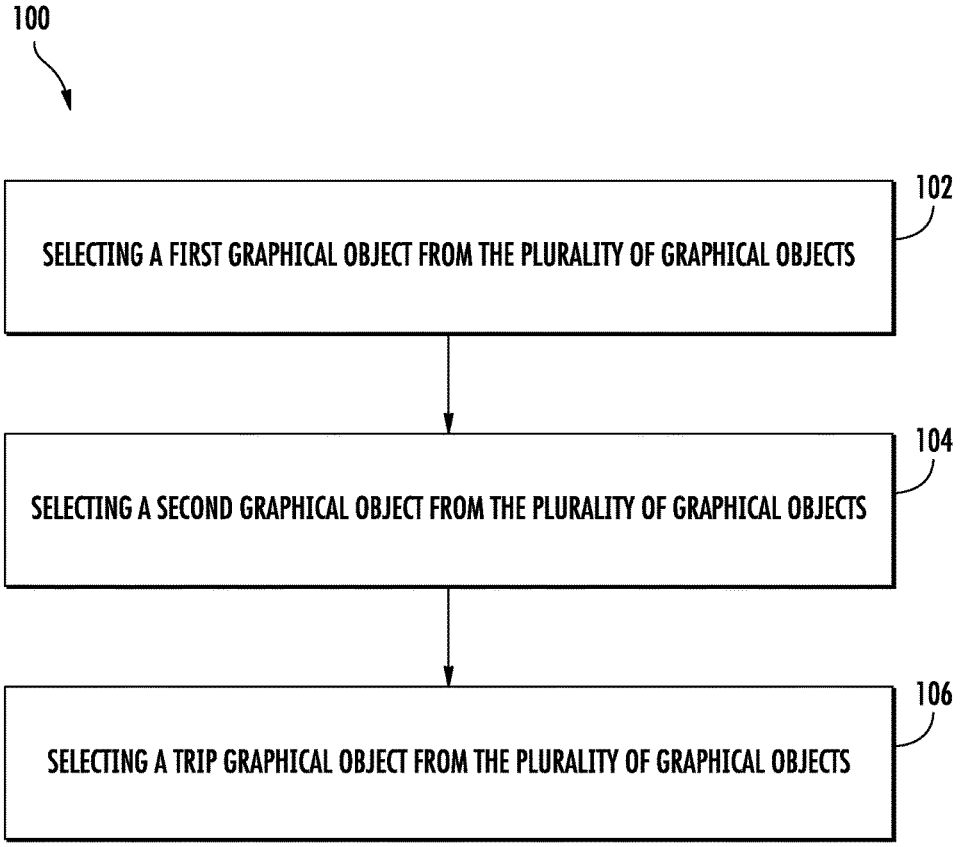
FIG. 2 is a schematic flow diagram of a method for initiating elevator service by initiating an elevator call.
Figure 3A:
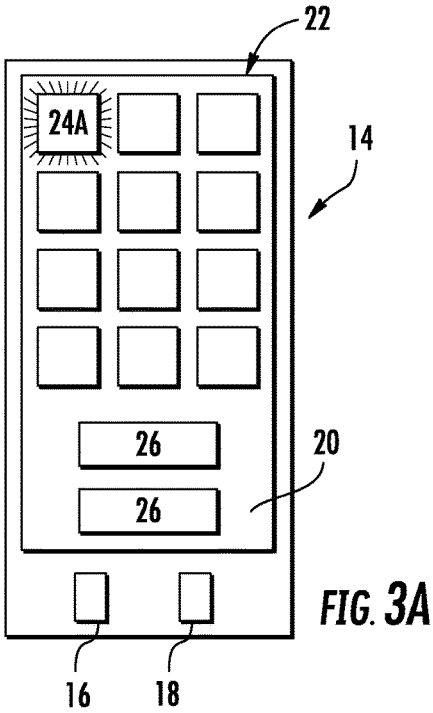
FIGS. 3A-3C are schematic diagrams of a call input device.

FIG. 2 illustrates a method 100 for initiating an elevator call using the system 10. The method includes the step 102 of selecting a current floor graphical object 24A from the plurality of graphical objects 22. In one embodiment, selecting the current floor graphical object 24A includes touching the current floor graphical object 24A at least once with an object (not shown). It will be appreciated that the object may include any object that may be detectable by the touchscreen display 20, such as a finger or stylus to name two non-limiting examples. In one embodiment, selecting the current floor graphical object 24A includes initiating a voice command with the call input device 14 to select the current floor graphical object 24A. In one embodiment, the selected current floor graphical object 24A designates the source landing of the user. For example, the user operates the program on the call input device 14 to initiate an elevator call; the user selects the source floor in which the user is currently located. If the user is located on the fourth floor of a building, the user selects the current floor graphical object 24A displayed on the graphical user interface 20 designating the fourth floor. In one embodiment, the program may suggest a current floor graphical object 24A for selection based at least in part on the user's travel history and/or anticipated travel. For example, as shown in FIG. 3A, if the user typically initiates an elevator call from the first floor around 8 am, the program may suggest the current floor graphical object 24A designated as the first landing by illuminating or shading the current floor graphical object 24A in a different color to name a couple of non-limiting examples. Alternatively, the program may suggest the current floor graphical object 24A based on the current floor graphical object 24A being the user's prior destination landing. For example, if the user's prior destination was the first floor, the program may suggest the current floor graphical object 24A designated as the first landing by illuminating or shading the current floor graphical object 24A in a different color to name a couple of non-limiting examples.

Figure 3B:
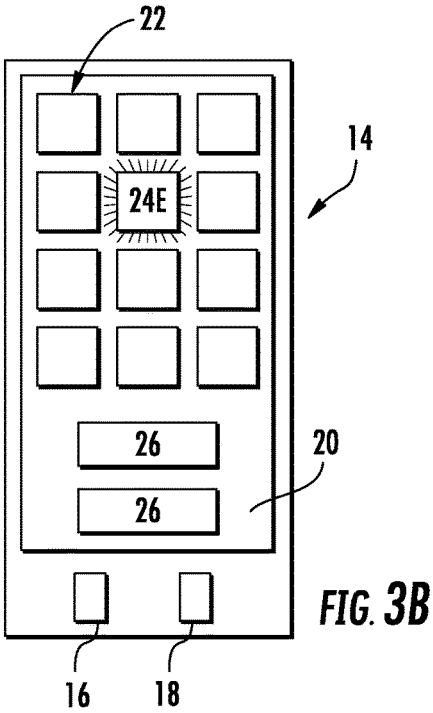

After selection of the current floor graphical object 24A, the method proceeds to step 104 of selecting a destination floor graphical object 24E from the plurality of graphical objects 22. In one embodiment, the selected destination floor graphical object 24E designates the desired destination landing of the user. In one embodiment, selecting the destination floor graphical object 24E includes moving the current floor graphical object 24A such that the current floor graphical object 24A overlays the desired destination floor graphical object 24E. For example, if the user desires to move from the fourth floor to the ninth floor, the user moves the current floor graphical object 24A designated for the fourth floor until the current floor graphical object 24A overlays the destination floor graphical object 24E designated for the ninth floor. In one embodiment, selecting the destination floor graphical object 24E includes touching the destination floor graphical object 24E at least once with an object. In one embodiment, selecting the destination floor graphical object 24E includes initiating a voice command with the call input device 14. In one embodiment, the program may suggest a destination floor graphical object 24E for selection based at least in part on the user's travel history and/or anticipated travel. For example, as shown in FIG. 3B, if the user typically initiates an elevator call to travel to the first floor around 12 pm, the program may suggest the destination floor graphical object 24E designated as the first landing by illuminating or shading the destination floor graphical object 24E in a different color to name a couple of non-limiting examples.

The method 100 further includes the step 106 of selecting a trip graphical object 26 from the plurality of graphical objects 22. After selection of the destination floor graphical object 24E, the program is configured to create at least one trip graphical object 26. The at least one trip graphical object 26 stores the recent selections of the user to allow for quick access to the travel history of the user. For example, if the user selected a current floor graphical object 24A designating the fourth floor and a destination floor graphical object 24E designating the ninth floor, the program creates a trip graphical object 26 designating travel in the up direction from the fourth floor to the ninth floor. It will be appreciated that the program may create a trip graphical object in the down direction if the source floor is higher than the desired destination landing.

Figure 3C:
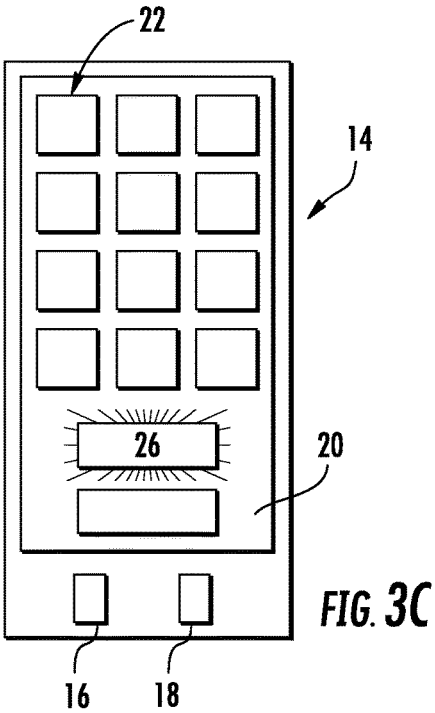

In one embodiment, the at least one trip graphical object 26 includes a return trip graphical object. For example, if the user selected a current floor graphical object 24A designating the fourth floor and a destination floor graphical object 24E designating the ninth floor, the program creates a return trip graphical object 26 designating the ninth floor as the source landing with a down direction call to the fourth floor as the desired destination landing. This allows the user to initiate a faster elevator call without the need to select a current floor graphical object and a destination floor graphical object. In one embodiment, the program may suggest a trip graphical object 26 for selection based at least in part on the user's travel history and/or anticipated travel. For example, as shown in FIG. 3C, if the user typically initiates an elevator call to travel from the first floor to the fifth floor to begin the work day around 8 am, the program may suggest a trip graphical object 26 with an up direction travel from the landing designated as the first floor to the landing designated as the fifth floor.

Figure 4:
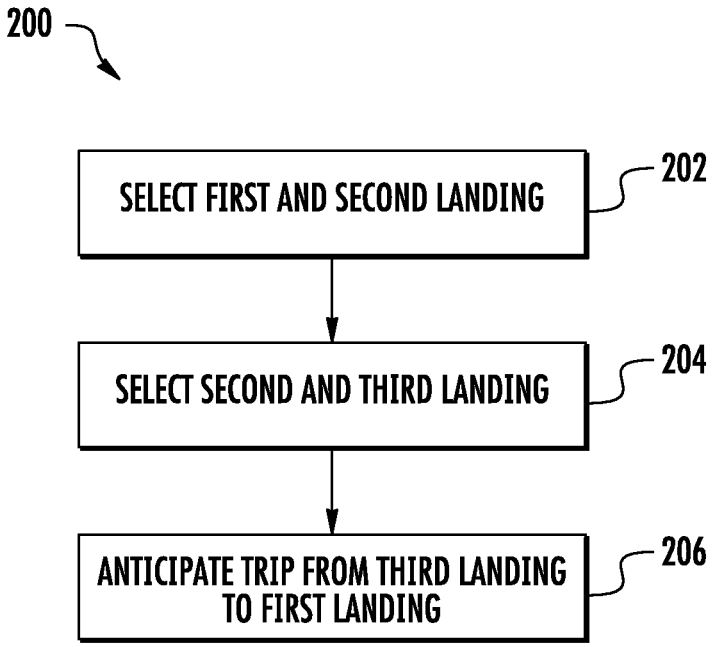
FIG. 4 is a schematic flow diagram of a method for initiating elevator service by anticipating an elevator call

FIG. 4 illustrates a method 200 for generating an anticipated trip graphical object. For example, at step 202, the user selects a current floor graphical object 24A designating a first landing and a destination floor graphical object 24E designating a second landing. Later, at step 204, the user selects a current floor graphical object 24A designating the second landing and a destination floor graphical object 24E designating a third landing. At step 206, the program generates an anticipated trip graphical object 26 designating the third landing as the source landing with a call to the first landing as the desired destination landing. For example, the user may select travel from the first floor to the ninth floor. Later, the user may select travel from the ninth floor to the fourth floor. The program then anticipates that the user may select travel from the fourth floor, the user's current landing, to the first floor, the user's original landing.

Accordingly, the program recognizes that the user has traveled among multiple floors within the building. The program then anticipates that the user intends to travel from the user's current landing to the original landing, where the user began travel. This allows the user to initiate a faster elevator call without the need to select a current floor graphical object and a destination floor graphical object.

It will be appreciated that a user may conveniently initiate elevator service from a call input device 14 by selecting a current floor graphical object 24A and a destination floor graphical object 24E from a plurality of graphical objects 22 displayed on a graphical user interface 20.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A method for initiating elevator service by entering an elevator call on a call input device having a plurality of graphical objects displayed on a graphical user interface, the method comprising the steps:

selecting a first landing graphical object from the plurality of graphical objects, the first landing graphical object corresponding to a single landing;

selecting a second landing graphical object from the plurality of graphical objects, the second landing graphical object corresponding to a single landing;

initiating a hall call and floor call from the first landing to the second landing;

selecting a third landing graphical object from the plurality of graphical objects, the third landing graphical object corresponding to a single landing;

initiating a hall call and floor call from the second landing to the third landing in response to selecting the third landing graphical object;

creating an anticipated trip graphical object in response to selecting the third landing graphical object, the anticipated trip graphical object indicating a trip from the third landing to the first landing; and selecting the anticipated trip graphical object to initiate a hall call and floor call from the third landing to the first landing.

2. The method of claim 1 further comprising selecting the anticipated trip graphical object.

3. The method of claim 1, wherein the call input device comprises a mobile device.

4. The method of claim 1, wherein the graphical user interface comprises a touch screen display.

5. The method of claim 1, wherein each of the plurality of graphical objects are moveable.

6. The method of claim 1, wherein selecting the anticipated trip graphical object, comprises:

touching the anticipated trip graphical object at least once with an object; and/or initiating a voice command with the call input device.

7. A system for making elevator calls comprising:

an elevator system;

a call input device, in communication with the elevator system;

wherein the call input device includes a graphical user interface and software configured to:

display a plurality of graphical objects on the graphical user interface; and initiate an elevator call by:

selecting a first landing graphical object from the plurality of graphical objects, the first landing graphical object corresponding to a single landing;

selecting a second landing graphical object from the plurality of graphical objects, the second landing graphical object corresponding to a single landing;

initiating a hall call and floor call from the first landing to the second landing;

selecting a third landing graphical object from the plurality of graphical objects, the third landing graphical object corresponding to a single landing;

initiating a hall call and floor call from the second landing to the third landing in response to selecting the third landing graphical object;

creating an anticipated trip graphical object in response to selecting a third landing graphical object, the anticipated trip graphical object indicating a trip from the third landing to the first landing; and selecting the anticipated trip graphical object to initiate a hall call and floor call from the third landing to the first landing.

8. The system of claim 7, wherein the call input device comprises a mobile device.

9. The system of claim 7, wherein the graphical user interface comprises a touch screen display.

10. The system of claim 7, wherein each of the plurality of graphical objects are moveable.

* * * * *